US008113458B2

(12) United States Patent
Chaussade et al.

(10) Patent No.: US 8,113,458 B2
(45) Date of Patent: Feb. 14, 2012

(54) DEVICE FOR PRINTING ON A STRIP OF PAPER IN THE FORM OF A ROLL ABOUT A SPOOL

(75) Inventors: Xavier Chaussade, Herblay (FR); François Dufresne De Virel, Paris (FR); Jean-François Lallemant, Shanghai (CN)

(73) Assignee: Morpho, Paris (FR)

( * ) Notice: Subject to any disclaimer, the term of this patent is extended or adjusted under 35 U.S.C. 154(b) by 605 days.

(21) Appl. No.: 11/546,323

(22) Filed: Oct. 12, 2006

(65) Prior Publication Data

US 2007/0091159 A1 Apr. 26, 2007

(30) Foreign Application Priority Data

Oct. 14, 2005 (FR) ..... 05 10481

(51) Int. Cl.
*B65H 63/08* (2006.01)

(52) U.S. Cl. ..... 242/563.2; 242/564.3

(58) Field of Classification Search ..... 242/563.2, 242/564.3, 564.4, 563, 564, 418, 419.2; 400/239, 400/244, 613, 76; 347/104, 101, 5, 14, 16, 347/19, 105; 399/16, 23, 303, 361, 375, 399/384; 358/1.12; 346/107.6, 134; 355/407
See application file for complete search history.

(56) References Cited

U.S. PATENT DOCUMENTS

| | | | | |
|---|---|---|---|---|
| 3,994,449 | A * | 11/1976 | Wales | 242/563.2 |
| 5,326,041 | A * | 7/1994 | Alexander et al. | 242/563 |
| 5,820,068 | A * | 10/1998 | Hosomi et al. | 242/563 |
| 6,502,784 | B1 * | 1/2003 | Sato | 242/563 |
| 7,058,539 | B2 * | 6/2006 | Fujita et al. | 702/157 |
| 2004/0234316 | A1 * | 11/2004 | Matsuse | 400/613 |

FOREIGN PATENT DOCUMENTS

| | | | |
|---|---|---|---|
| EP | 0 794 064 | A2 | 6/1997 |
| JP | 2000-190603 | A | 7/2000 |
| JP | 2001-130808 | A | 5/2001 |

* cited by examiner

*Primary Examiner* — William E Dondero
(74) *Attorney, Agent, or Firm* — Muncy, Geissler, Olds & Lowe, PLLC

(57) ABSTRACT

A device for printing on a strip of paper shaped as a roll about a spool, the device comprising a housing for receiving the roll, means for supporting the roll from beneath in the housing and for horizontally centering the roll substantially on a vertical reference axis, a travel path for the strip of paper from the housing to a printer member, and a control member associated with a drive member for driving the strip of paper along the travel path, the device comprises at least one sensor for sensing the position of the spool along the vertical reference axis, the sensor being secured to at least one side face of the housing, and being connected to the control member for controlling the drive member.

18 Claims, 1 Drawing Sheet

DEVICE FOR PRINTING ON A STRIP OF PAPER IN THE FORM OF A ROLL ABOUT A SPOOL

The present invention relates to a device for printing a strip of paper in the form of a roll about a spool. By way of example, the device can be used in a system for issuing receipts or slips in respect of transactions or bets, or indeed in a cash register or any other apparatus or system of the same type.

BACKGROUND OF THE INVENTION

Such a printer device generally includes a housing for receiving the roll, a travel path for the strip of paper from the housing to a printer member, and a control member associated with a drive member for driving the strip of paper along the travel path. The housing is fitted with support means for supporting the roll from beneath inside the housing and for horizontally centering the roll on a vertical reference axis. Those means commonly comprise two parallel cylinders that are spaced apart from each other and that are mounted to rotate in the bottom of the housing so as to support the roll, while automatically centering it between them so as to encourage regular delivery of the strip of paper into the travel path without jolting. The control member controls the drive member to operate at a speed that is substantially constant and compatible with the speed of the printer member, with the power consumed by the drive member, and with the power consumed by the printer member. In practice, this speed is set to the maximum drive speed that the drive member can achieve when the roll is full, where this speed is always slower than the speed of the printer member during ordinary printing operations. Nevertheless, when printing dense zones that put a heavy demand on the printer member, it can happen that the control member causes the drive member to operate at a slower speed in order to limit the electricity consumption of the drive member for the benefit of the printer member.

It has been envisaged to increase the drive speed during ordinary printing operations by using a more powerful drive member. Unfortunately, such a drive member significantly increases the electricity consumption of the printer device and runs the risk of being under used because of the way electrical power is shared between the drive member and the printer member, with power being fed to the printer member on a priority basis.

OBJECT OF THE INVENTION

An object of the invention is to provide simple means enabling the printing speed of a printer device to be increased.

BRIEF DESCRIPTION OF THE INVENTION

To this end, the invention provides a device for printing on a strip of paper in the form of a roll about a spool, the device comprising a housing for receiving the roll, means for supporting the roll from beneath in the housing and for horizontally centering the roll substantially on a vertical reference axis, a travel path for the strip of paper from the housing to a printer member, and a control member associated with a drive member for driving the strip of paper along the travel path, the device including at least one sensor for sensing the position of the spool along the vertical reference axis, the sensor being secured to at least one side face of the housing, and being connected to the control member for controlling the drive member.

Thus, the sensor for sensing the position of the spool serves to detect the position of the spool along the vertical reference axis, i.e. the height of the spool relative to the support means, which corresponds to the radius of the roll. The radius of the roll is directly representative of the weight of the roll, and thus of the force that the drive member needs to deliver in order to drive the strip of paper when taking paper from the roll. This force determines the maximum drive speed. Since the weight of the roll decreases as the strip of paper is used up, it is possible to increase the drive speed. In the device of the invention, the control member thus causes the drive member to operate at a speed that is a function of the signal that is delivered thereto by the position sensor and that is representative of the radius of the roll. The sensor is positioned on a side face of the housing which constitutes a stationary portion of the printer device, thereby making it easier to install the sensor. In addition, the positioning of the sensor on the side face of the housing can limit the interference caused by the sensor when changing roll, which generally takes place through the top of the housing. In addition, if the housing is closed by a transparent cover, the lateral position of the sensor makes it completely or almost invisible from the outside when looking through the cover of the housing. The lateral positioning of the sensor, when the sensor is an optical sensor, also makes it possible to limit the quantity of interfering light that might reach the sensor.

In a particular embodiment, the device includes a plurality of sensors for sensing the position of the spool, the sensors being secured to at least one of said side walls of the housing, substantially along the reference axis.

It is then possible, by means of sensors that are simple, to detect a plurality of values for the radius of the roll, and to control the drive member as a function of said values.

Advantageously, the sensors are spaced apart by a distance that is shorter than a diameter of the spool.

Thus, there is always one sensor detecting the spool. As a result there is no need to have recourse to a memory for recording the position of the spool.

Also advantageously, each sensor is arranged to emit and receive an electromagnetic ray in a direction parallel to a central axis of the spool of the roll and, preferably, the spool is tubular, and each sensor comprises an emitter element secured to said side face and a receiver element secured facing it on an opposite side face of the housing.

The structure of the device is then particularly simple, and the use of optical sensors ensures that the device presents good reliability.

In a variant, the sensor is a passive sensor for sensing the presence of the spool and the spool includes a portion making it detectable by the sensor.

Other characteristics and advantages of the invention appear on reading the following description of a particular, non-limiting embodiment of the invention.

BRIEF DESCRIPTION OF THE DRAWING

Reference is made to the accompanying drawing, in which.

DETAILED DESCRIPTION OF THE INVENTION

Figure 1:
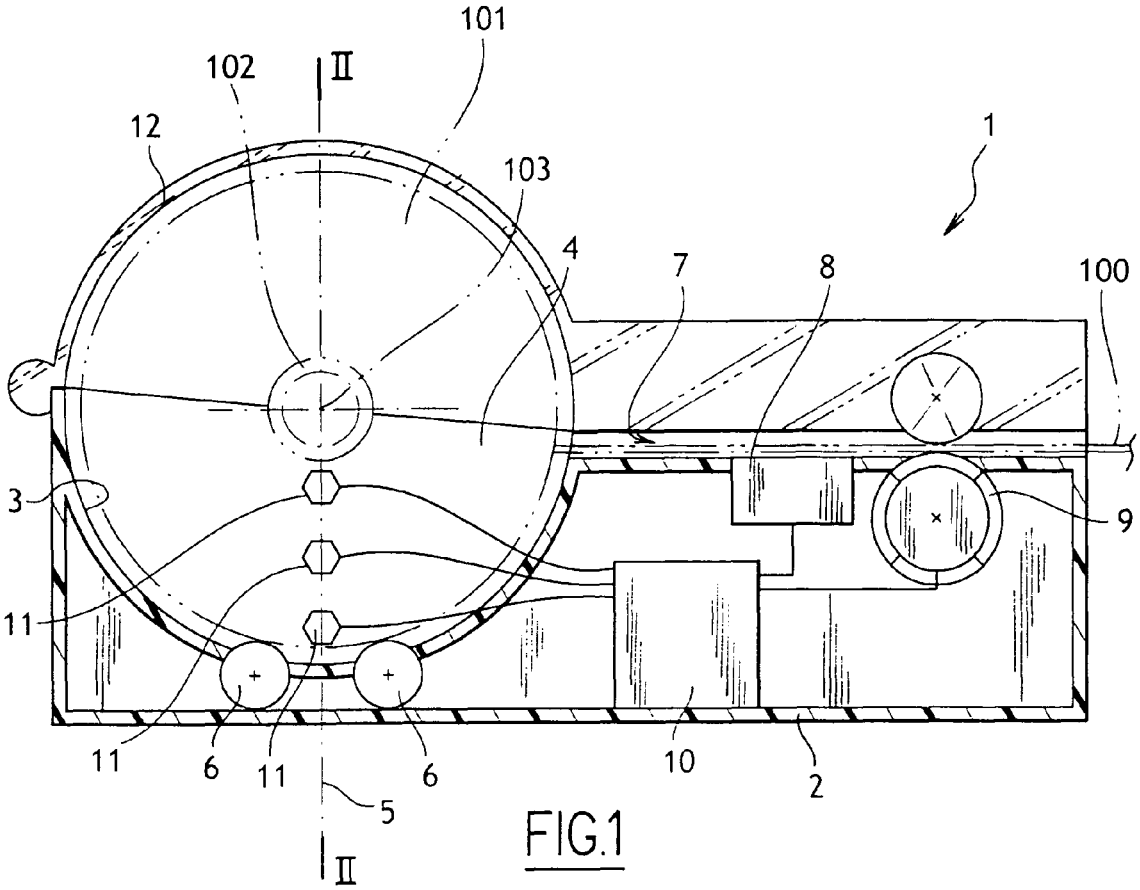
FIG. 1 is a diagrammatic longitudinal section view of a device in accordance with the invention.
Figure 2:
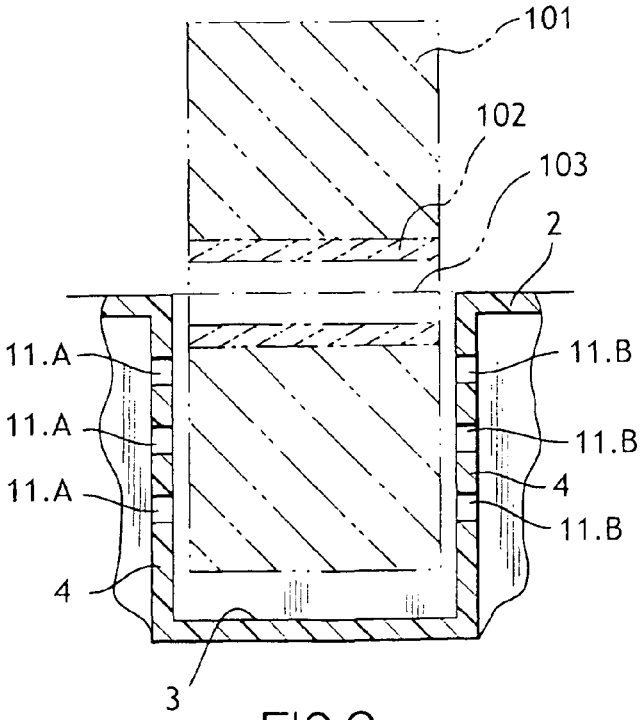
FIG. 2 is a diagrammatic cross-section view of the device on plane II of FIG. 1.

With reference to the figures, the printer device in accordance with the invention is for printing on a strip of paper 100 in the form of a roll 101 about a spool 102 of tubular shape and having a central axis 103. The spool 102 in this example does not have cheek plates.

The printer device, given overall reference 1, comprises a case 2 defining a housing 3 for receiving the roll 101. The housing 3 has two side walls 4 between which means are located for supporting and horizontally centering the roll 101 substantially on a vertical reference axis. The support and centering means comprise two cylinders 6 spaced apart from each other, each having a central axis perpendicular to the side walls 4, and both mounted in the housing 3 so as to rotate freely about their respective central axes (the vertical chain-dotted line referenced 5 is the perpendicular bisector of a line intersecting the axes of the two cylinders 6 perpendicularly). The housing has a top opening that is closed by a cover 12, in this case a transparent cover, that is mounted to tilt on the side walls 4.

The case 2 defines a travel path 7 for the strip of paper 100 from the housing 3 to a printer member 8 of known type. A driver member 9 for driving the strip of paper 100 projects into the travel path 7. The driver member 9 is conventional and comprises a wheel rotated by an electric motor.

The printer member 8 and the electric motor of the drive member 9 are connected to a conventional control member 10. Nevertheless, in this device, the control member includes a memory containing a table associating values of a parameter for controlling the speed of the drive member with signals delivered by sensors 11, to which the control member 10 is also connected. The sensors 11 serve to sense the vertical position of the spool 102 along the reference axis 105. In this example, the sensors 11 are active sensors arranged to emit and receive light rays in directions parallel to the central axis 103 of the spool 102 of the roll 101. In this example, the sensors 11 operate in the visible range, but they could equally operate in the near infrared (preferably in the sensitivity range of silicon). Each sensor 11 comprises an emitter element 11.A secured on one of the side faces 4, and a receiver element 11.B secured facing it on the opposite side wall 4 of the housing 3. The emitter and receiver elements 11.A and 11.B are secured on the side faces 4 of the housing substantially along the reference axis 5. The sensors 11 are spaced apart in pairs by a distance that is shorter than the diameter of the spool 102.

The operation of the printer device 1 is described below.

When a new roll 101 is placed in the housing 3, none of the sensors 11 is facing the spool 103. During subsequent printing operations, the control member 10 acts by default and causes the drive member to operate at its slowest nominal speed corresponding to a full roll.

After a predetermined length of the strip of paper 100 has been delivered, the spool 102 comes into the vicinity of the highest sensor 11. The light ray emitted by the corresponding emitter element 11.A passes through the spool 102 and is detected by the facing receiver element 11.B. The receiver element 11.B then delivers an electrical signal that is received by the control member 10, which causes the drive member 9 to operate at a higher speed determined on the basis of the received signal.

After another predetermined length of the strip of paper 100 has been delivered, the highest sensor 11 is no longer in register with the spool 102, which has moved to become level with the sensor 11 situated immediately below it. As before, the light ray emitted by the corresponding emitter element 11.A then passes through the spool 102 and is detected by the facing receiver element 11.B. The receiver element 11.B then sends an electrical signal that is received by the control member 10, which causes the drive member to run at an even faster speed determined on the basis of the received signal.

When the lowest sensor 11 detects the spool 102, the control member 10 causes the drive member 9 to run at its highest speed and also issues a warning signal, e.g. by means of an indicator lamp or an audible signal, warning that the roll 101 is coming to its end and will need to be changed.

Although the drive speed is determined by the control member 10 in nominal manner as a function of the signals from the sensors 11, the control member 10 can nevertheless reduce this speed whenever the printer member 8 needs to print dense zones.

It should be observed that in the event of one or more of the sensors 11 failing, the control member 10 that has not received a signal causes the drive member 9 to run at its slowest speed, thus avoiding any risk of the strip of paper 100 becoming torn or jammed.

In addition, when the printer device is designed to receive rolls of different radii, the sensors 11 can detect the radius of the roll 101 placed in the housing 3 and cause the drive member 9 to be run at a speed that is appropriate for the radius.

The lowest sensor 11 can also serve to detect whether or not a roll is present.

Naturally, the invention is not restricted to the embodiment described but covers any variant coming within the ambit of the invention as defined by the claims.

In particular, the printer device may be of a structure that is different from that described and, by way of example, it may include a plurality of drive members, a scanner head, a travel path of some other shape, . . . .

The number of sensors may be different, and the printer device need have only one sensor. The sensors may also be spaced apart by a distance that is greater than the diameter of the spool. The sensors may also be disposed in alternation on the two side faces of the housing so as to make them easier to install. The sensors may also be slightly offset from the reference axis 105 and they may be embedded to a greater or lesser extent in the side face, or on the contrary they may project to a greater or lesser extent therefrom.

The sensor may be of a structure that is different from that described: for example, the sensor may comprise a single transceiver element, with detection operating as a result of the contrast that exists between the side face of the roll 101 (generally white) and of the spool (in which case there is no need for the spool to be hollow). The sensor may be active or passive and may operate on a variety of principles: optical, magnetic, thermal, . . . . The sensor may be a passive magnetic sensor if the spool includes a magnet.

The spool may have side cheek plates of small diameter.

What is claimed is:

1. A device for printing on a strip of paper shaped as a roll about a spool, the device comprising:

a housing for receiving the roll, means for supporting the roll from beneath in the housing and for horizontally centering the roll substantially on a vertical reference axis, a travel path for the strip of paper from the housing to a printer member, a control member associated with a drive member for driving the strip of paper along the travel path, at least one sensor, arranged to emit and receive an electromagnetic ray in a direction parallel to a central axis of the spool of the roll, for sensing the position of the spool along the vertical reference axis and generating a signal representing the radius of the roll and indicating said position, the sensor being secured to at least one side face of the housing, the sensor being connected to the control member by a connecting member so that a speed of the drive member is selected by the control member as a function of the signals generated by the sensor; wherein when the signal representing the radius of the roll indicates a decreasing radius, the signal is received by the control member which increases the speed of the drive member.

2. A device according to claim 1, including a plurality of sensors for sensing the position of the spool, the sensors being secured to at least one of said side faces of the housing, substantially along the reference axis.

3. A device according to claim 2, in which the sensors are spaced apart by a distance that is shorter than a diameter of the spool.

4. A device according to claim 1, in which the spool is tubular, and each sensor comprises an emitter element secured to said side face and a receiver element secured facing it on an opposite side face of the housing.

5. A device according to claim 1, wherein the sensor is a passive sensor for sensing the presence of the spool and wherein the spool includes a portion making it detectable by the sensor.

6. A device according to claim 1, wherein when the printer member prints dense zones, a signal is received by the control member which reduces the speed of the drive member.

7. A device according to claim 1, wherein in the event of a failure, the control member causes the drive member to have a slowest speed.

8. A device according to claim 1, wherein when one of the sensors detects a first radius of the roll, the signal representing the radius of the roll is received by the control member which causes the drive member to be driven at a speed appropriate for said first radius.

9. A device according to claim 1, wherein one of the sensors detects the presence of the roll.

10. A device for printing on a strip of paper shaped as a roll about a spool, the device comprising:

a housing for receiving the roll, means for supporting the roll from beneath in the housing and for horizontally centering the roll substantially on a vertical reference axis, a travel path for the strip of paper from the housing to a printer member, a control member associated with a drive member for driving the strip of paper along the travel path, at least one sensor for sensing the position of the spool along the vertical reference axis and generating a signal representing the radius of the roll and indicating said position, the sensor being secured to at least one side face of the housing, the sensor being connected to the control member by a connecting member so that a speed of the drive member is selected by the control member as a function of the signals generated by the sensor;

wherein when the signal representing the radius of the roll indicates a decreasing radius, the signal is received by the control member which increases the speed of the drive member.

11. A device according to claim 10, including a plurality of sensors for sensing the position of the spool, the sensors being secured to at least one of said side faces of the housing, substantially along the reference axis.

12. A device according to claim 11, in which the sensors are spaced apart by a distance that is shorter than a diameter of the spool.

13. A device according to claim 10, in which the spool is tubular, and each sensor comprises an emitter element secured to said side face and a receiver element secured facing it on an opposite side face.

14. A device according to claim 10, wherein the sensor is a passive sensor for sensing the presence of the spool and wherein the spool includes a portion making it detectable by the sensor.

15. A device according to claim 10, wherein when the printer member prints dense zones, a signal is received by the control member which reduces the speed of the drive member.

16. A device according to claim 10, wherein in the event of a failure, the control member causes the drive member to have a slowest speed.

17. A device according to claim 10, wherein when one of the sensors detects a first radius of the roll, the signal representing the radius of the roll is received by the control member which causes the drive member to be driven at a speed appropriate for the first radius.

18. A device according to claim 10, wherein one of the sensors detects the presence of the roll.

* * * * *